United States Patent [19]

Horiuchi et al.

[11] Patent Number: 4,723,526

[45] Date of Patent: Feb. 9, 1988

[54] DRIVE ARRANGEMENT FOR SUPERCHARGER

[75] Inventors: Kenji Horiuchi, Iwata; Toru Ichinose, Fukuroi, both of Japan

[73] Assignee: Yamaha Hatsudoki Kabushiki Kaisha, Iwata, Japan

[21] Appl. No.: 840,782

[22] Filed: Mar. 18, 1986

[30] Foreign Application Priority Data

Mar. 19, 1985 [JP] Japan ..... 60-53338
Mar. 27, 1985 [JP] Japan ..... 60-60800

[51] Int. Cl.[4] ..... F02B 33/00
[52] U.S. Cl. ..... 123/559
[58] Field of Search ..... 123/559, 65 BA; 417/364

[56] References Cited

U.S. PATENT DOCUMENTS

| | | | |
|---|---|---|---|
| 1,281,644 | 10/1918 | Ostergren | 123/65 BA X |
| 1,399,871 | 12/1921 | Pearson | 417/364 X |
| 2,252,512 | 8/1941 | Keller | 123/65 BA X |
| 2,741,234 | 4/1956 | Wiseman | 123/559 |
| 4,460,056 | 7/1984 | Jaccod | 123/559 X |

*Primary Examiner*—Michael Koczo
*Attorney, Agent, or Firm*—Ernest A. Beutler

[57] ABSTRACT

A motor vehicle having a transversely disposed supercharged engine. The engine output shaft is connected to a flywheel which is connected to a transmission for driving the front wheels of the vehicle. The supercharger is positioned at one end of the engine and is driven directly from the engine flywheel by a belt drive. The other engine accessories are driven at the opposite end of the engine.

8 Claims, 3 Drawing Figures

Fig-1
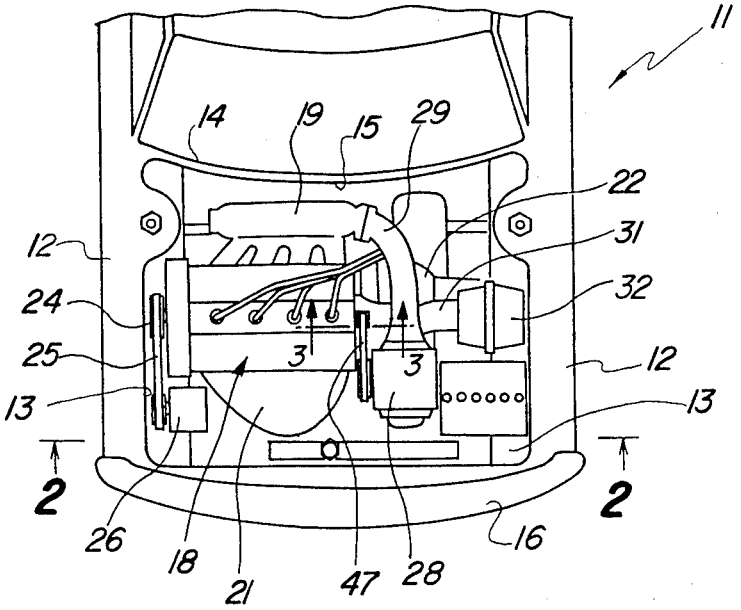
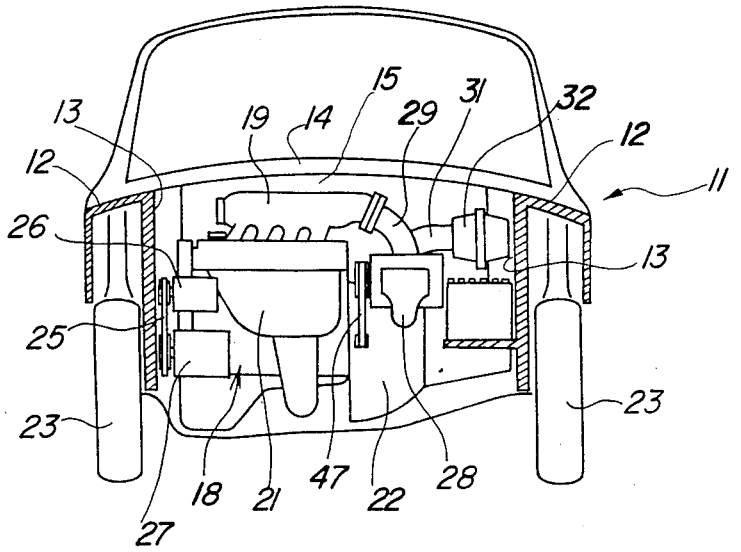
Fig-2

DRIVE ARRANGEMENT FOR SUPERCHARGER

BACKGROUND OF THE INVENTION

This invention relates to a drive arrangement for a supercharger and more particularly to an improved drive arrangement for a supercharged automotive engine.

Recently, superchargers have enjoyed considerable popularity as a means for increasing the power output of an internal combustion engine without increasing its displacement. Although a wide variety of arrangements are provided for driving the supercharger of an engine from the engine, the driving arrangements generally fall into two distinct categories. In one of these categories, the supercharger embodies a turbine stage that is driven by the engine exhaust gases so as to drive its compressor stage. This type of supercharger is generally called a turbocharger or exhaust turbocharger. In the other form of arrangement, the supercharger is driven directly by the engine through some mechanical drive. The turbocharger basically has the advantage of simplicity, however, the fact that the exhaust gases are used to drive the turbine stage gives rise to cooling and heat problems and the volumetric efficiency loses attendant to the heating of the supercharged air mixture. However, on the other hand, the mechanical drive of the supercharger from the engine presents certain difficulties when one considers the number of additional accessories that are driven by the engine in modern motor vehicles. In vehicles having the transverse engine placement, the driving arrangement becomes even more complicated and difficult.

It is, therefore, a principal object of this invention to provide an improved driving arrangement for a supercharger.

It is a further object of this invention to provide a supercharger driving arrangement wherein the supercharger is driven mechanically from the engine in such a way as not to interfere with the other engine driven accessories.

SUMMARY OF THE INVENTION

In accordance with the invention, an engine is provided with an output shaft that drives a flywheel. A supercharger is provided for delivering a compressed air charge to the engine induction system and is driven directly by the engine flywheel.

BRIEF DESCRIPTION OF THE DRAWINGS

FIG. 1 is a top plan view of a portion of a motor vehicle constructed in accordance with an embodiment of the invention and shows particularly the engine compartment with the hood removed.

FIG. 2 is a cross-sectional view taken generally along the line 2—2 of FIG. 1.

DETAILED DESCRIPTION OF THE PREFERRED EMBODIMENT

Figure 3:
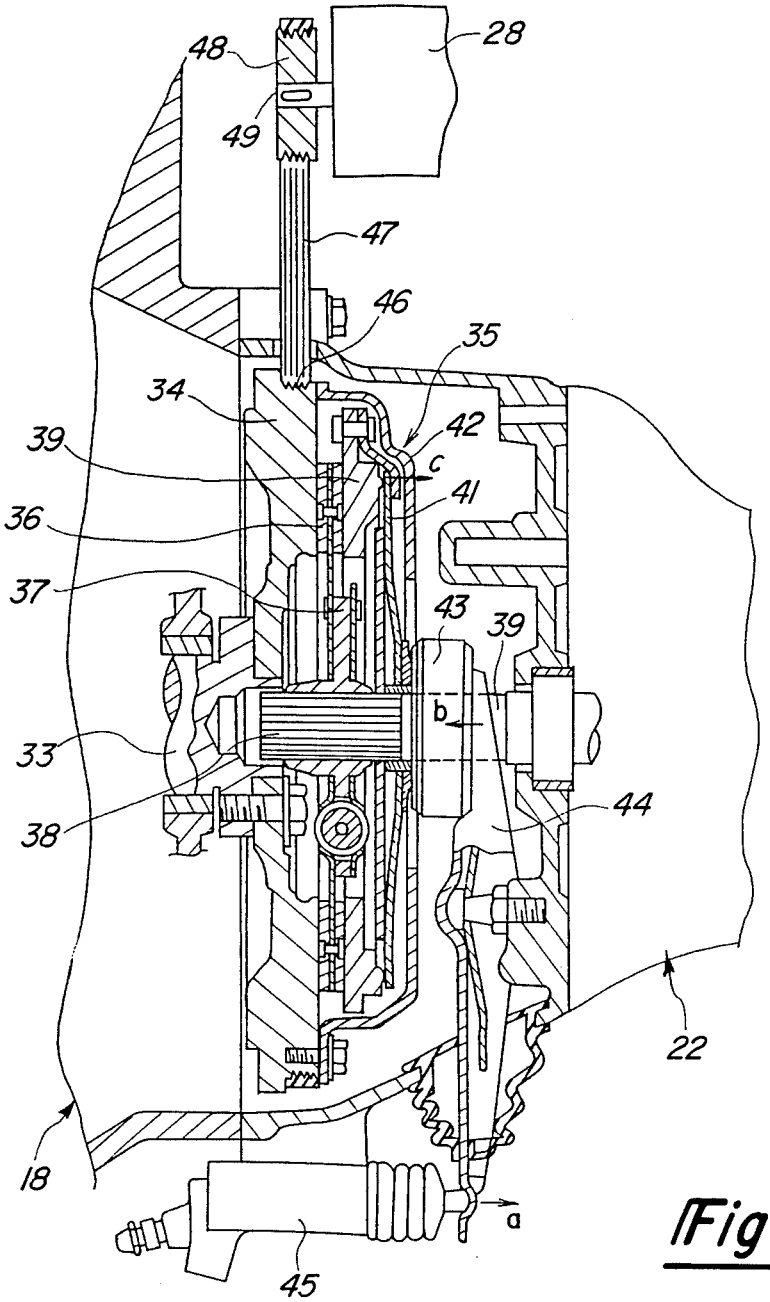
FIG. 3 is an enlarged cross-sectional view taken along the line 3—3 of FIG. 1 and shows the arrangement for driving the supercharger.

Referring first primarily to FIGS. 1 and 2, a motor vehicle constructed in accordance with an embodiment of this invention is identified generally by the reference numeral 11. The motor vehicle 11, in the illustrated embodiment, is of the front engine, front wheel drive type. In addition, as will become apparent, the engine is disposed with its rotational axis extending transverse to the longitudinal center line of the vehicle 11. It is to be understood, however, that certain facets of the invention may be utilized in conjunction with rear wheel driven cars, rear engine rear wheel driven cars and cars having engines disposed in other than a transverse relationship.

The motor vehicle 11 includes a pair of front fenders 12 having fender aprons 13 which define in part an engine compartment. In addition, a cowling 14 separates this engine compartment from the passenger compartment and includes a firewall 15. A front bumper 16 is positioned forwardly of the front fenders 12 and is disposed contiguous to a grill which permits cooling air to be delivered to the engine compartment. The construction of the motor vehicle as thus far described is conventional and, for that reason, details of the various components of the body are not believed to be necessary to understand the invention.

An engine, indicated generally by the reference numeral 18, is positioned within the engine compartment and is disposed so that its output shaft (to be described) rotates about an axis that extends transversely to the longitudinal center line of the vehicle. The engine 18 is depicted as being of the inline type, although certain facets of the invention may be used with engines having other configurations such as V type engines. The engine 18 is provided with an induction system that includes an intake manifold 19 that is positioned on the firewall side of the engine 18. In addition, an exhaust system which includes an exhaust manifold 21 is positioned on the air inlet side of the engine 18.

The engine output shaft drives a clutch (to be described) and transmission assembly 22 that is positioned at one end of the engine 18. The transmission assembly 22, in turn, drives a pair of front wheels 23 by means of a differential and axle shafts. The front wheels 23 are contained within the front fenders 12.

A numer of accessories may be driven from the engine and these are normally driven from the end opposite to that which drives the transmission 22. For this purpose, one or more pulleys 24 may be connected to the engine output shaft and drive a plurality of belts 25 for driving such accessories. These accessories may include a generator or alternator 26 and an air conditioning compressor or power steering pump 27. In addition, any other known types of engine driven accessories may be driven from the engine output shaft via belts 25 at the one end of the engine.

In accordance with the invention, a supercharger, indicated generally by the reference numeral 28, is positioned at the opposite end of the engine. In this way, the supercharger 28 can be driven positively from the engine output shaft without interfering with the other accessory drives. The supercharger 28 may be of any known type such as a positive displacement type of compressor or a centrifugal compressor. The discharge from the supercharger 28 is delivered through an outlet pipe 29 to an inlet of the intake manifold 19 so as to pressurize the inlet air delivered to the manifold 19. A source of outside air is delivered to the supercharger 28 through an inlet conduit 31 from an air cleaner and air silencer 32.

The manner and construction for driving the supercharger 28 may be best understood by additional reference to FIG. 3 wherein the engine output shaft, which may be a crankshaft in the case of a reciprocating engine, is identified by the reference numeral 33. As has previously been noted, the engine output shaft 33 rotates about an axis that extends transversely to the longitudinal center line of the vehicle 11. A flywheel 34 is connected, in a known manner, to the engine output shaft 33 and, in turn, drives a clutch assembly 35.

The clutch assembly 35 includes a driven disk 36 that is connected by means of a hub 37 to a splined inlet end 38 of a transmission input shaft 39. The frictional surfaces of the driven disk 36 are maintained in engagement with the flywheel 34 by means of a pressure plate 39 which is, in turn, acted upon by a diaphragm 41 contained within a clutch housing 42 which is, in turn, affixed to the flywheel 34. A throwout bearing 43 operates upon the diaphragm 41 for selectively releasing the clutch under the control of a clutch lever 44. The clutch lever 44 is, in turn, operated by a slave cylinder 45 which is driven by a clutch master cylinder (not shown) that is connected to the clutch pedal for operator control. When the operator depresses the clutch pedal, the slave cylinder will exert a force on the lever 44 in the direction of the arrow a so as to force the throwout bearing 43 in the direction of the arrow b so as to release the clutch 35 as is well known in this art.

In accordance with the invention, the flywheel 34 is provided with a pulley sprocket surface 46 that receives a belt 47 which, in turn, drives a pulley 48 affixed to an input shaft 49 of the supercharger 28. In this manner, the supercharger 28 is driven directly and mechanically from the engine flywheel 34 at the end opposite to which the normal engine accessories are driven. The improved placement which will insure against interference with the other accessory drives.

Although the invention has been described in conjunction with a preferred embodiment, it is to be understood that various changes and modifications may be made without departing from the spirit and scope of the invention, as defined by the appended claims.

What is claimed is:

1. An internal combustion engine for driving a vehicle, said engine having an output shaft, a flywheel fixed for rotation to said output shaft, a transmission driven by said flywheel for powering the vehicle, a supercharger for delivering a compressed air charge to the engine induction system and means for mechanically driving said supercharger directly from said flywheel.

2. An internal combustion engine as set forth in claim 1 wherein the flywheel drives the supercharger through a flexible transmitter.

3. An internal combustion engine as set forth in claim 2 wherein the flywheel is formed with an integral sprocket for driving the flexible transmitter.

4. An internal combustion engine as set forth in claim 1 wherein there are a plurality of accessories driven by the engine at the end opposite to the flywheel.

5. An internal combustion engine as set forth in claim 1 in combination with a motor vehicle wherein the engine is positioned with its output shaft extending transversely to the longitudinal axis of the motor vehicle.

6. An internal combustion engine as set forth in claim 5 wherein the flywheel drives the supercharger through a flexible transmitter.

7. An internal combustion engine as set forth in claim 6 wherein the flywheel is formed with an integral sprocket for driving the Fflexible transmitter.

8. An internal combustion engine as set forth in claim 7 wherein there are a plurality of accessories driven by the engine at the end opposite to the flywheel.

* * * * *